US005133129A

United States Patent [19]

Thomson, Jr.

[11] Patent Number: 5,133,129

[45] Date of Patent: Jul. 28, 1992

[54] METHODS OF PRODUCING MICROWAVE DEVICE

[75] Inventor: John Thomson, Jr., Spring Lake, N.J.

[73] Assignee: AT&T Bell Laboratories, Murray Hill, N.J.

[21] Appl. No.: 552,368

[22] Filed: Jul. 16, 1990

Related U.S. Application Data

[63] Continuation of Ser. No. 289,890, Dec. 27, 1988, abandoned.

[51] Int. Cl.[5] ..... H01P 11/00

[52] U.S. Cl. ..... 29/600; 264/12; 264/13; 264/65; 501/134; 501/137

[58] Field of Search ..... 501/137, 134; 264/65, 264/12, 13; 29/600

[56] References Cited

U.S. PATENT DOCUMENTS

| | | | |
|---|---|---|---|
| 3,938,064 | 2/1976 | O'Bryan, Jr. et al. | 333/73 |
| 4,318,995 | 3/1982 | Rhodes et al. | 501/137 |
| 4,337,446 | 6/1982 | O'Bryan, Jr. et al. | 333/238 |
| 4,563,661 | 1/1986 | O'Bryan, Jr. et al. | 333/202 |

*Primary Examiner*—James Derrington

*Attorney, Agent, or Firm*—Oleg E. Alber

[57] ABSTRACT

This invention concerns with microwave devices including resonant elements made from dielectric materials represented by the nominal formulas $Ba_2Ti_9O_{20}$, $BaTi_4O_9$, $ZrTiO_4$ (Sn) and the like. The resonant element is produced conventionally by a process including numerous steps of mixing, drying, screening, calcining, ball milling, drying, screening or remilling and spray drying, forming and sintering. These steps may take 72 hours or more, prior to the forming step, and are labor and energy consuming. The improvement resides in the use of a reduced number of steps which include mixing precursor powders with addition of water and dispersants, spray drying or flocculating and drying the mixed formulation, forming and reactively sintering, so as to reduce the total processing time, prior to the forming step, to form about 8 to 24 hours. The sintering step is conducted in an oxygen-enriched atmosphere and may be followed by soaking and annealing to enhance the Q characteristics of the element. Resultant product characteristics, e.g. Q's, are superior or at least comparable to those of the conventionally produced product.

54 Claims, 4 Drawing Sheets

FIG. 2
REACTIVE SINTERING
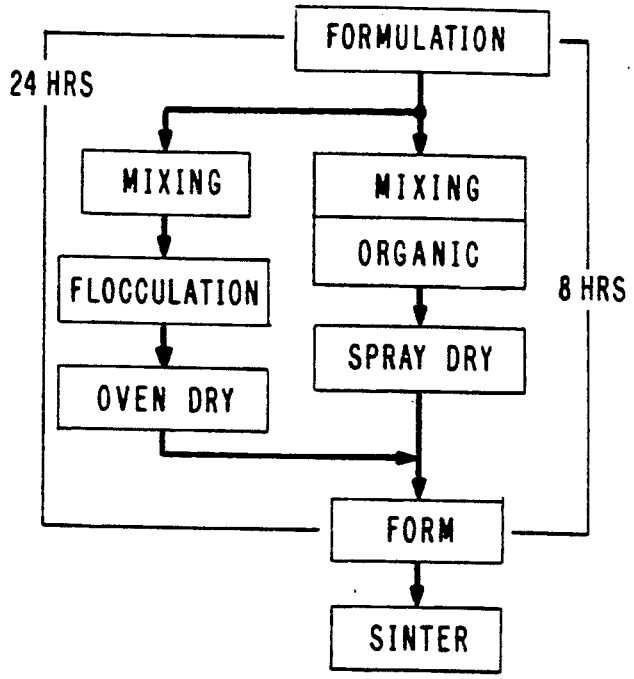
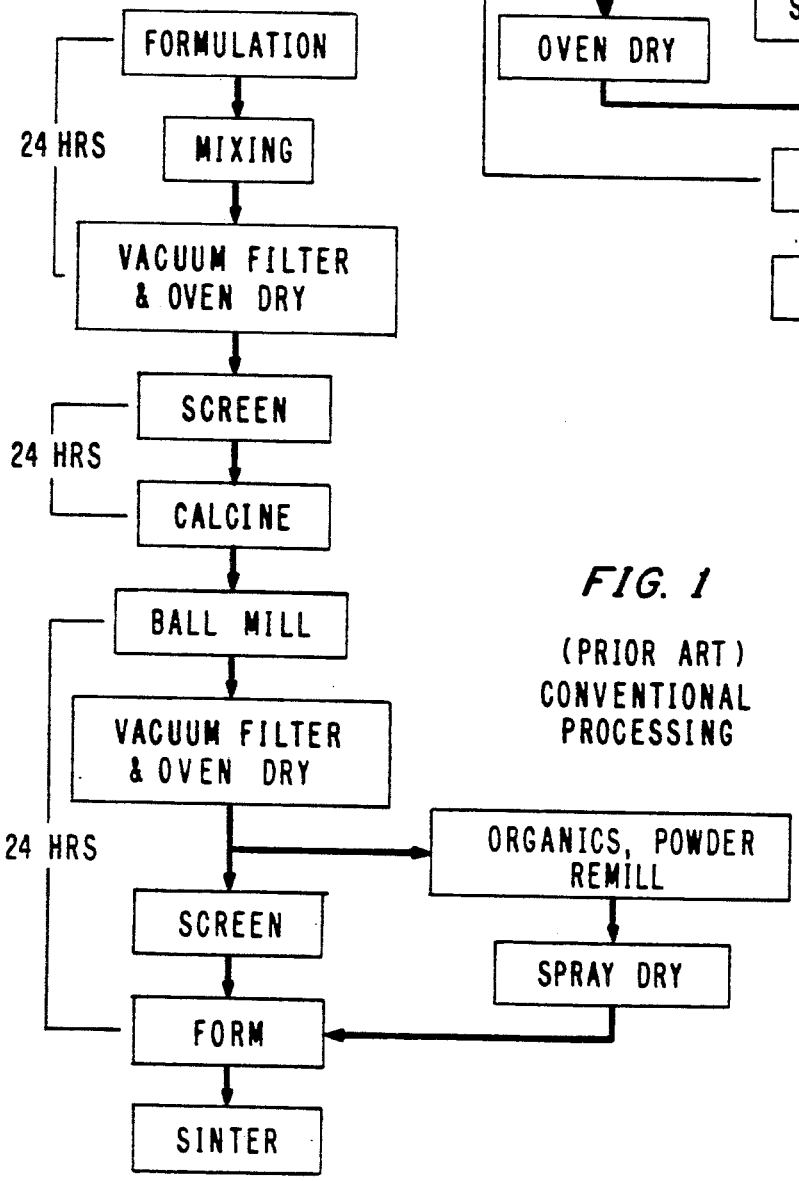
FIG. 1
(PRIOR ART)
CONVENTIONAL PROCESSING

METHODS OF PRODUCING MICROWAVE DEVICE

This application is a continuation of application Ser. No. 289,890, filed on Dec. 27, 1988, now abandoned.

TECHNICAL FIELD

The invention relates to methods of preparing bodies of dielectric material for use in microwave devices and microwave devices using such bodies.

BACKGROUND OF THE INVENTION

A variety of microwave devices utilize dielectric material including those with the nominal formulas $Ba_2Ti_9O_{20}$, $BaTi_4O_9$, and $ZrTiO_4$, with or without other additives, such as tin [e.g., $ZrTiO_4(Sn)$]. Typical devices are dielectric resonator filters, microwave stripline circuits, various types of oscillators, as well as phase shifters, bandpass filters, etc. The material requirements for microwave devices include, at least, moderately high dielectric constant, low loss at the appropriate frequency and a high temperature stability.

The widespread use of the dielectric material in microwave devices occurred with the discovery that a material of the nominal formula $Ba_2Ti_9O_{20}$ has low temperature coefficients of frequency ($T_f$), high dielectric constants (K) and low microwave losses (high Q). This material is described in a number of references including U.S. Pat. No. 3,938,064 issued to H. M. O'Bryan, Jr., et al. on Feb. 10, 1976, U.S. Pat. No. 4,337,446 issued to H. M. O'Bryan, Jr. et al. on Jun. 29, 1982, and U.S. Pat. No. 4,563,661 issued to H. M. O'Bryan, Jr. et al. on Jan. 7, 1986, each of which is incorporated herein by reference.

These materials are produced by a lengthy and labor and energy demanding processing. Typically the processing involves numerous steps which include formulating a composition, mixing (e.g. ball milling), drying, screening, calcining, comminuting by ball milling, drying, screening (or remilling and spray drying), forming into a suitable shape and sintering. These steps may extend over a period of 72 hours or more prior to the forming step. A flow chart of a representative conventional (prior art) processing is illustrated in FIG. 1 of the drawings.

It is highly desirable to produce these materials by a less cumbersome process and, yet, to obtain a material useful for microwave devices.

SUMMARY OF THE INVENTION

The invention is concerned with a process for fabricating an apparatus for processing microwave electrical energy which includes a body of dielectric material for interaction with a microwave electrical energy, the dielectric material being selected from the group consisting of dielectric materials having the nominal formula $Ba_2Ti_9O_{20}$, $BaTi_4O_9$, $ZrTiO_4$ and $ZrTiO_4(Sn)$, means for introducing microwave electrical energy to the body of dielectric material, and a conducting member to contain the microwave energy, wherein said body of dielectric material is prepared by wet mixing as an aqueous slurry of preferred oxidic precursor powders of said dielectric material, including $TiO_2$, and a dispersant, drying the mixture into a powder, forming the dried powder into a green form body, and reactively sintering the formed body in an oxidizing atmosphere to, simultaneously, react and sinter the precursor powders into a body having the said nominal formula; the sintered body may, optionally, be annealed. The processing time is drastically reduced due to the reduction in processing time prior to the forming step.

The low loss (high Q), dielectric constant and thermal stability of the material required for use in microwave apparatus, are provided, e.g. in case of $Ba_2Ti_9O_{20}$, by reducing the amount of the $TiO_2$ precursor powder by from 1.5 to 3.0 wt. percent from the amount required for producing one molecular weight of stoichiometric nominal formula, initially heating the green form body in an oxygen atmosphere at a rate of less than 200° C./hr. to a desired sintering temperature of from 1350° C. to 1420° C., and soaking the body at said sintering temperature for a period of up to 24 hours; optionally the sintered body may be annealed in an oxygen atmosphere.

BRIEF DESCRIPTION OF THE DRAWING

FIG. 1 is a flow chart of a typical conventional (prior art) processing for preparing dielectric materials for use in microwave devices.

FIG. 2 is a flow chart of preparing the dielectric materials in accordance with the invention.

DETAILED DESCRIPTION

Figure 3:
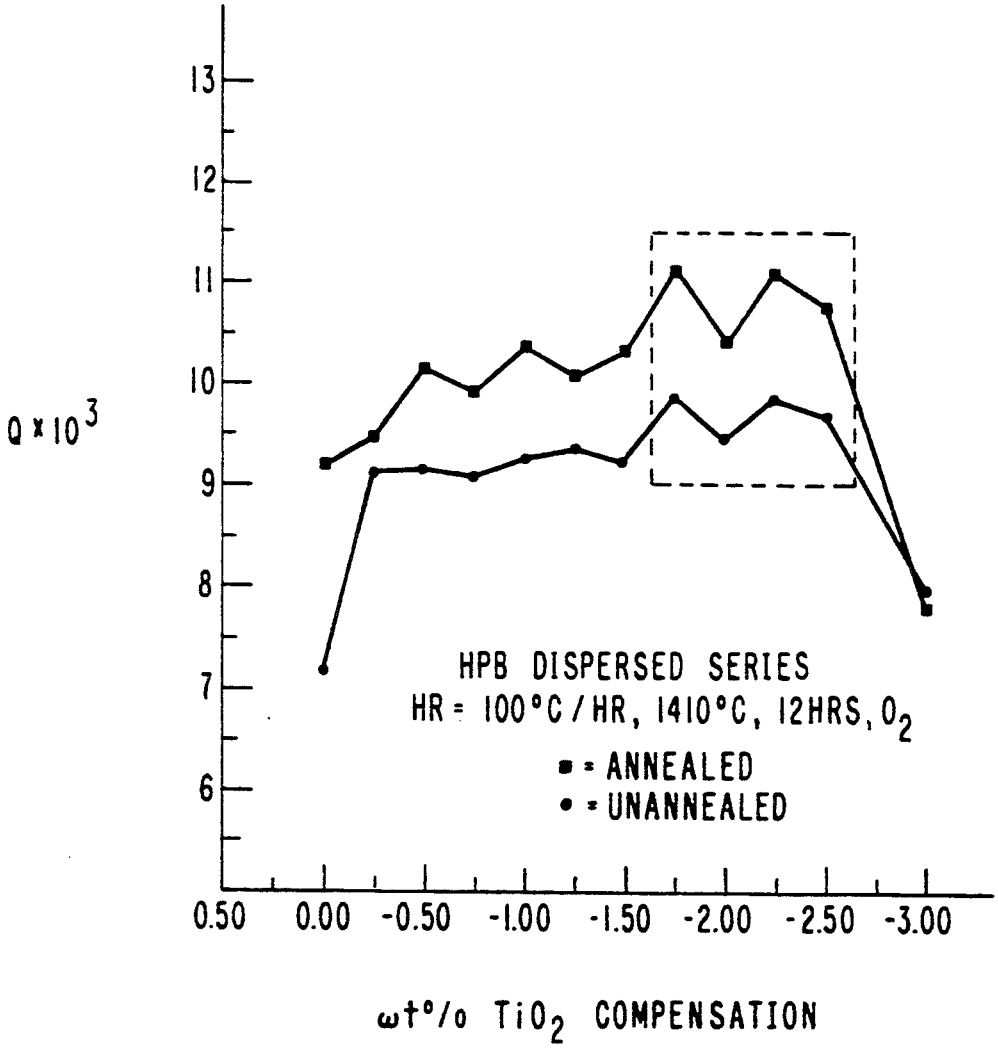
FIGS. 3 through 7 are curves that are useful in describing an exemplary dielectric material prepared in accordance with the invention.

The invention is a process for fabricating a microwave device comprising dielectric ceramic material selected from materials with nominal formula $Ba_2Ti_9O_{20}$, $BaTi_4O_9$, $ZrTiO_4$ which may include additives such as Sn, e.g. $ZrTiO_4(Sn)$, which is prepared by the process with a greatly reduced number of processing steps, relative to a conventional processing. The dielectric material is comprised of at least 90 mole percent of a ceramic material with said nominal formula. The remaining 10 mole percent may be inert material, binder material, etc. In general, best results are obtained when at least 99 mole percent of the dielectric material is composed largely of $Ba_2Ti_9O_{20}$. Such ceramic material is useful in a variety of microwave devices including passband filters, signal source devices, band rejection filters and other microwave devices that process microwave signals. For the purposes of this application, signal frequencies from 0.4 to 200 GHz are regarded as microwave devices. Dielectric materials are especially useful for resonator applications over the 0.5–20 GHz frequency range.

The present invention will be described with reference to exemplary dielectric materials having the nominal formula $Ba_2Ti_9O_{20}$. Nevertheless, the principles of the invention are applicable to the other dielectric materials also. A variety of methods have been used for the preparation of the dielectric material. Exemplary prior art preparation procedures have been described in U.S. Pat. Nos. 3,938,064 and 4,337,446, noted above, incorporated herein by reference. One typical conventional (prior art) method of preparing the materials is illustrated by the flow chart in FIG. 1 of the drawings.

In the conventional method, appropriate amounts of starting materials that yield BaO and $TiO_2$, such as reagent grade $BaCO_3$ or $BaTiO_3$ and $TiO_2$, are mixed in a conventional manner, such as by wet ball milling. The mixed reagents are filtered, dried, screened and reacted (calcined) at a temperature between 1000° and 1200° C. for a period of from 1 to 48 hours preferably 2–6 hours at a temperature of 1125° to 1175° C. The calcined material is comminuted at least by wet ball milling, the milled material is filtered and dried and then either screened or remilled and spray dryed, after which the particulate material is formed into a desired green shape, e.g., small cylinders, and sintered. The forming and sintering steps may be conducted a) by hot pressing involving pressures ranging from $6.9\times10^6$ to $41.4\times10^6$ Pa (1000–6000 psi) and temperatures between 1150° C. and 1400° C. for a period of from 30 minutes to 10 hours; the hot pressed form may then be submitted to reoxidizing at a temperature of from 900° C. to 1400° C. for a period of from 4 to 100 hours, or b) by first cold pressing at a pressure ranging from $13.8\times10^6$ to $68.9\times10^6$ Pa (2000–10000 psi) and then sintering by heating at a rate of below 300° C. per hour to a temperature between 1300° C. and 1420° C. followed by soaking the material for a period of from 1 to 24 hours, followed by cooling; the sintered shapes may also be reoxidized as stated in a) above.

However, the conventional processing is time-consuming and labor and energy demanding. For example, in the conventional prior art processing, the processing from formulation to forming takes up to 72 hours. Attempts to utilize "reactive sintering" concepts to reduce the number of processing steps, including calcining, and the length of the processing time prior to the forming and sintering steps led to dielectric materials with severe microcracking rendering them unsuitable for use in microwave devices. "Reactive sintering" may be defined as a process in which the reaction of ingredients and the formation of a final dense product takes place in a single heat-treating (sintering) step instead of at least two separate heat-treating steps, one for reacting the starting ingredients (a calcining step) and another for sintering a body, formed from the calcined (reacted) material, into a final dense product. Reactive sintering (RS) has been applied by others to obtain dense ceramics. For example, it has been used to form mullite and Nd-doped $Ba_2Ti_9O_{20}$ ceramic. See, respectively, P. D. D. Rodrigo and P. Boch, "High Purity Mullite Ceramics by Reaction Sintering", Int. J. High Technology Ceramics, 1 (1985) 3–30, and T. Jaakola, J. Möttönen et al. "Preparation of Nd-doped $B_2Ti_9O_{20}$ Ceramics for Use in Microwave Applications", Ceramics International, Vol. 13, No. 3 (1987), pp. 151–157.

The present invention is a time expedient processing that eliminates many of the intermediate processing steps associated with conventional processing of dielectric materials. It is based on the recognition that by proper selection of precursor materials and preparation of a dry particulate material using only a few selected steps, it is possible to produce chemical homogeneity for the desired chemical composition which, when formed into a desired shape, may be easily reactively sintered into a dense product of a microwave device grade. Under certain conditions, as described herein below, it is a viable method for producing high Q (low loss), dense and crack-free ceramic material, such as $Ba_2Ti_9O_{20}$.

The processing may be outlined with reference to FIG. 2 of the drawings. As shown therein, the processing is considerably simplified versus the conventional processing and the potential processing savings are dramatic (e.g. processing time of 8 hrs or 24 hrs versus 72 hrs).

Reactive sintering seems to be more appropriate for chemical compounds which are made from nonvolatile precursors; not uncommon in many ceramic systems. For instance, decomposition and out-gassing of a carbonate or sulfate precursor (i.e. $BaCO_3$ or $BaSO_4$), often used in the conventional processing, in a compacted powder shape during sintering could present problems in obtaining a structurally sound ceramic. This potential volatility limitation may be easily avoided by the use of $BaTiO_3$ and of $TiO_2$ as the preferred sources of Ba and Ti, as described hereinbelow.

HPB and 5016 grades of $BaTiO_3$ and 1020 grade $TiO_2$ (anatase) are used to prepare mixed powders for the reactive sintering. The HPB grade $BaTiO_3$ and the 5016 grade $BaTiO_3$ are commercially obtainable from TAM Ceramics, Niagara Falls, N.Y., U.S.A. and the 1020 grade $TiO_2$ from NL Industries, Hightstown, N.J., U.S.A. The two grades of $BaTiO_3$ represent about an order of magnitude difference in purity levels and significant differences in price. HPB grade $BaTiO_3$, which is of a higher purity grade than 5016 grade $BaTiO_3$ material, costs almost four times as much as the latter; nevertheless, the HPB grade $BaTiO_3$ may be preferred to obtain a higher quality (higher Q) product. The anatase form of $TiO_2$ is preferred since the conventionally used rutile form does not seem to be reactive enough to produce a structurally sound ceramic.

Appropriate amounts of $BaTiO_3$ and $TiO_2$ precursor powders are mixed together by wet (aqueous) ball milling with addition of a dispersant and converted into a dried mixed material, which is then formed into a desired shape, usually a cylindrical form, and sintered. The precursor powders should preferably be initially of a fine particle size ($\leqq 1$ μm) needed to produce simultaneously chemical homogeneity for the desired chemical composition and an easily sinterable dense ceramic.

The starting materials are formulated so as to provide a slight excess of Ba over a stoichiometric amount of Ti needed to produce $Ba_2Ti_9O_{20}$. This is accomplished by admixing a lesser amount of $TiO_2$ precursor powder than is needed to prepare one molecular weight of stoichiometric $Ba_2Ti_9O_{20}$. In preparing the mixture of stoichiometric amounts of $BaTiO_3$ and $TiO_2$ needed for producing one molecular weight of $Ba_2Ti_9O_{20}$, the amount of $TiO_2$ being added is reduced ("compensated") by from 1.25 to 3.00, preferably from 1.75 and 2.75, weight percent of the $TiO_2$ powder so as to create a deficiency of Ti (or excess of Ba) from these stoichiometric amounts. For instance, 466.48 g of $BaTiO_3$ and 559.23 g of $TiO_2$ are required to prepare one molecular weight of stoichiometric $Ba_2Ti_9O_{20}$. A 2.00 wt. percent of $TiO_2$ reduction in the amount being added (−2.00 wt. percent $TiO_2$ compensation) means that the $TiO_2$ component has been reduced by 2.00 percent or by 11.18 g.

The precursor powders are combined with a suitable liquid into a slurry to be ball milled. To facilitate ball milling and, thus mixing, it is desirable that the slurry should be of a relatively low viscosity such as 200–400 cps. To reduce the drying time of the ball milled powders, the liquid is added in an amount sufficient to permit efficient blending of the precursor powders. In this invention, water is the preferred liquid, and is added in an amount of from 200 to 400 ml, preferably 300 ml of water per 1.0 kg of dry precursor powders. This favorably compares with a conventional processing wherein the amount of water being used in the slurry, typically ranges from 1500 to 2000 ml of water per 1.0 kg of dry powders.

The dispersant is added to this slurry to increase the mixing efficiency during the ball milling step. The need for an organic dispersant in the powder mixing phase (ball milling) of the processing scheme became evident from an observation of polished ceramic sections fabricated from reactive sintering of nondispersed powders. The ceramic had a porous, multiphased appearance indicating poor blending of powder ingredients. Addition of the dispersant permitted reduction in the volume of the liquid being used in forming the slurry as well as an improvement in the mixing efficiency of the precursor powders. A simple explanation of the effect of a dispersant is that organic molecules are absorbed on all surfaces of the powder particles. The absorbed molecules, depending upon the nature of the dispersant, either create a steric repulsion because long chained polymer molecules act to prevent close approach of neighbor particles or the particles are separated by an electrostatic repulsion due to the development of an electric double layer. For microwave dielectric applications, some caution must be exercised in selecting a dispersant. It should be free of cations, particularly $Na+$, and insensitive to slight changes in slurry pH. Dispersants suitable for use with aqueous solutions may be selected from complex glassy phosphates, condensed aryl sulfonic acids, and ammoniated deflocculants. An ammonium polyacrylate dispersant, Darvan 821A commercially obtainable from R. T. Vanderbilt, Norwalk, Conn., U.S.A., proved to be satisfactory. The dispersant is added in an amount of from 0.7 to 1.2 wt. percent, preferably 0.9 wt. percent, based on the total weight of the dry powder.

The mixing, drying and forming may be conducted in two different ways. For each variant, the mixing is conducted for a period of from about 6 to 16 hours, the 6 hours being the preferred mixing time, with 16 hours being a convenient, overnight mixing time. Shorter periods of mixing may be used provided it should be sufficient for blending the powders.

In one variant, identified as "flocculation", an appropriate amount of $BaTiO_3$ and $TiO_2$ is wet mixed in a ball mill with a dispersant for from 6 to 16 hours, then a small amount of an agent (hereinafter referred to as "flocculant") which neutralizes the effect of the dispersant, is added to permit flocculation, and the flocculated material is dryed and screened. The screened, binderless powder (or powder having a minimal amount of binder) is formed into a desired shape and sintered in an oxygen atmosphere. The total processing time from formulation to forming is less than about 24 hours.

In another variant, identified as "spray-drying", an appropriate amount of $BaTiO_3$ and $TiO_2$ are wet mixed in the ball mill preferably for about 6 hours, with the addition to the mixture of the dispersant and various other organic additives, such as binders, plasticizers, wetting agents and lubricants. These additives are added in wt. percent (as described below) based on the total amount of dry powders. The milled mixture is then spray-dried, formed into a desired shape and sintered. In this variant the total time, from formulating to forming is about 8 hours.

The dispersants are the same and are used in the same amounts as those being used in the flocculation variant, Darvan 821A being the preferred dispersant. The binders are selected from acrylic polymers, acrylic polymer emulsions, ethylene oxide polymer, hydroxyethyl cellulose, methyl cellulose, polyvinyl alcohol, TRIS isocyanamide and wax lubricants. The preferred binder is polyvinyl alcohol. The binders are being used in an amount of from 1.0 to 5 wt. percent, preferably 2.5 wt. percent. The plasticizers are being selected from butyl benzyl phthalate, dibutyl phthalate, ethyl toluene sulfonamides, glycerine, polyalkylene glycol, triethylene glycol, tri-N-butyl phosphate, polyethylene glycol (Carbowax TM, having molecular weight of 2000). The preferred plasticizer is Carbowax TM. The plasticizers are being used in an amount of from 0.25 to 0.75 wt. percent, preferably 0.5 wt. percent, with the total preferred amount of the binder and plasticizer being 3.0 wt. percent. The wetting agents are selected from non-ionic octyl phenoxyethanol and 2-octonol in an amount of from 0.5 to 1.5 wt. percent. These wetting agents may also be added to the aqueous solution (ball milling step) as defoamers in an amount of 10–20 ml. of the defoamer per 1000 ml. of water. The lubricant is $NH_4$stearate being added in an amount of from 0.5 to 1.0 wt. percent, preferably 0.75 wt. percent.

The above lists of the organic additives are not exhaustive. Any other organic additives may be added to the powders prior to the forming step as is well known in the art to facilitate the formation of the powders into a green form suitable for sintering. The only requirement is that these additives should not affect or lead to residues which could affect the microwave properties of the sintered material.

The two mixing variants are being described hereinbelow in greater detail.

FLOCCULATION

To prepare dispersed, flocculated powder, appropriate amounts of $BaTiO_3$ and $TiO_2$ were weighed and added to a 1 liter polyethylene container half filled with 0.95 cm. (⅜") dia×0.95 cm. (⅜") long $ZrO_2$ grinding cylinders. For a 1 kg, batch, 300 ml of deionized water and 2.00 wt. percent of a dispersant, such as Darvan 821A, were added after the $BaTiO_3$ had been placed into a 1 liter container. The dispersant was added in an amount of 2.00 wt. percent based on the dry weight of $BaTiO_3$, corresponding to 0.9 wt. percent of dispersant based on the total dry weight of $BaTiO_3$ and $TiO_2$. The container was then shaken to wet and disperse the powder. Because of the powder volume, the $TiO_2$ component was added in stages with brief agitation of the jar between additions.

This sequence of powder additions to the container is favored in the case of 1020 $TiO_2$ powder addition due to the slightly acidic nature (pH 5–6) of the 1020 $TiO_2$ powder. With neutralized $TiO_2$, this sequence is not important. However, in this case a slurry of low viscosity could be formed only if the mixing of the $BaTiO_3$, water and dispersant is followed by the $TiO_2$ addition. The 1020 $TiO_2$ is slightly acidic (pH 5–6) and, when initially combined with water and dispersant, yields a flocculated (high viscosity) slurry. This prevents subsequent incorporation of the $BaTiO_3$ component. In contrast, when the $BaTiO_3$ is added to the container first, yielding a slurry of pH 8, it neutralizes the acidity of the subsequently added $TiO_2$. Therefore, the dispersing agent is not affected and an essentially pH neutral dispersed mixture is obtained.

The added contents were then mixed by rolling the container for 6–16 hours on a jar mill. As stated before, 6 hours mixing time is sufficient for intimately blending the ingredients, while higher blending times, e.g., 16 hours, could be used for convenience sake (e.g., unattended overnight mixing). At the end of mixing, a flocculant, such as dilute acetic acid, about 10–20 ml of a 25 to 75 vol. percent, preferably 50 volume percent solution per 1 liter batch, was added to the slurry in the container to prevent segregation of the powder components during drying. Other dilute acids, such as citric, lactic, etc., are also appropriate. The flocculant is used to neutralize the effectiveness of the dispersant to deflocculate the dispersed slurries and, thus, prevents segregation during drying of the mixed powders resulting in intimately mixed, binderless powder which is suitable for forming by isostatic pressing followed by reactive sintering. The viscosity of the slurry can be adjusted from a few centipoise to >100,000 cps by controlled additions of the acid allowing the slurry to be either transferred to a pan for drying, or, as a sludge, to be dried in the original mixing container. The precursor powders should not decompose and/or dissolve in the flocculant.

Attempts to vacuum filter dispersed mixtures of HPB $BaTiO_3$ without addition of the flocculant produced badly segregated powders because of the time required for filtering (2–3 hours) and the density difference between the precursors (6.0 g/cm$^3$ for $BaTiO_3$ and 4.2 g/cm$^3$ for $TiO_2$). The acid addition, on the other hand, neutralizes the effectiveness of the dispersing agent for deflocculating the particles, causing the particles within the slurry to coagulate and rapidly produce a thick sludge.

Following flocculation, the open container was placed into a drying oven regulated at about 120° C. After drying, the powder was screened through a 297 micrometer (50 mesh) stainless steel screen with the aid of a Ro-Tap shaker. The processed powder may be used immediately or stored (e.g. in a polyethylene jar) prior to pressing and sintering.

SPRAY DRYING

The "flocculation" is effective in greatly reducing the period of processing time, prior to the forming step (24 hrs vs. 72 hrs). The procedure of FIG. 2 entitled "spray drying" leads to still further minimization of the time between the mixing initiation and sintering of the powder to its final shape and increase in the batch size being processed at a single processing. In this variant, the processing time, from formulation to forming, is reduced from 24 hours to 8 hours. The reduction in time is primarily due to the substitution of a step of spray-drying the mixed slurry for the drying and screening steps. Also, instead of 1 kg. of powders being processed in a 1 liter container, 3 kg. of powders are being processed in a 4 liter container, thus increasing the batch size threefold.

To a 4 liter container, half filled with $ZrO_2$ cylinders, 1399.44 gms of HPB or 5016 grade $BaTiO_3$, 1000 ml of deionized water and 2.00 wt. percent (based on the dry weight of $BaTiO_3$) of a dispersant (Darvan 821A) were added. The container was agitated to wet and disperse the powder. The $TiO_2$, suitably compensated, was then added in stages to the container and the contents were mixed for 5 hours. A binder (2.5 wt. percent of polyvinyl alcohol), plasticizer (0.5 wt. percent of Carbowax TM with molecular weight of 2000), lubricant (0.75 wt. percent 33% ammonium stearate) and an anti-foaming agent (10 ml of 2-octonol) were then added in aqueous or suspension form to the container and mixed for one additional hour. The slurry was transferred to a 4 liter beaker, continuously stirred with a motor driven paddle and spray dried in a Bowen Laboratory spray dryer. Therein atomized droplets of a solution or slurry are entrained in a cyclonic flow of heated air [93°–149° C. (200°–300° F.)] which rapidly produces dried spherical particles and deposits them at a collection site. The processed powder may be used immediately or stored for the future forming (pressing) and sintering steps.

NONDISPERSED POWDERS

For comparison purposes, three 1 kg. batches of non-dispersed HPB grade $BaTiO_3$ and 1020 grade $TiO_2$ (−1.50, −1.75 and −2.00 wt. percent $TiO_2$ compensated) were prepared to assist in determining the effectiveness of the dispersant in reactive sintering processing as both a fabrication and a sintering aid. This amount of dry powder required a 4 liter polyethylene container half filled with $ZrO_2$ grinding media and 1800 ml of deionized water to obtain a slurry with an initial viscosity of 200–300 centipoise. At the end of 16 hours of mixing the slurry viscosity increased to near 1000 cps due to particle size reduction and/or de-agglomeration. The slurry was poured into a Buchner Funnel and filtered (about 2 to 3 hours) with the slurry viscosity minimizing the segregation of the ingredients during filtering. The filter cake was placed into a drying oven for final drying. The dried material was then screened through a 297 micrometer (50 mesh) stainless steel screen and stored in a polyethylene jar for the future forming and sintering steps.

FORMING AND SINTERING

Samples with binder (spray dried) and without binder (dispersed-flocculated and filtered non-dispersed) were cold pressed in a steel pressing die to a green diameter of 16 cm (0.625 inches) and about 0.5 cm (0.200 inches) thick. These dimensions yielded sintered parts with a resonant frequency near 4.0 GHz. A forming pressure of $10.4\times10^6$Pa (1500 psi) was used with binderless powder and $68.9\times10^6$Pa (10,000 psi) for parts with binder. However, other forming pressures within a range of from $6.9\times10^6$Pa (1000 psi) to $17.2\times10^6$Pa (2500 psi) may be used with binderless powder and within a range of from $55.2\times10^6$Pa (8000 psi) to $172.4\times10^6$Pa (25000 psi) may be used for samples formed from powder with binder, as well. Any other shapes and sizes may be used to produce parts with a different desired resonant frequency.

Resistant heated tube furnaces were used for the sintering experiments. Sample discs of each composition were placed in platinum-lined alumina boats covered with platinum sheet to retard discontinuous grain growth that can occur on exposed surfaces at the higher sintering temperatures (e.g. ≧1400° C.). An oxygen atmosphere was used exclusively during the sintering experiments.

To sinter, the temperature was raised at a rate of up to 400° C./hr. to a desired sintering temperature between 1300° C. and 1420° C. where it was kept (soaked) for a period of from 1 to 24 hours, followed by cooling. After sintering, an additional annealing step in an oxygen atmosphere at temperatures ranging from 900° to 1400° C. for a period from 4 to 100 hours is optional; nevertheless, most samples were annealed by reheating to 1150° C. for 6 hours and cooling to ambient at a rate of 100° C./hr. to assure oxidation of any $Ti^{3+}$.

The sintered samples were tested to determine their suitability for use in microwave devices. Densities were measured for each sample using the Archimedes immersion technique in $CCl_4$. The physical integrity of each was also tested by boiling sectioned disks in water for 16 hrs, drying, immersing in a penetrating dye, rinsing in acetone and inspecting for residual dye penetration (indicative of microcracking). The phase distributions of most samples were examined optically by viewing polished surfaces with reflected monochromatic light at up to 500 x.

Dielectric constants were calculated for each composition from capacitance values measured at 1 MHz with an HP-4192A Impedance Analyzer. The samples were first ultrasonically metallized with a low melting In-Pb-Ga alloy. Q measurements at 4 GHz were made on unmetallized parts with a Hewlett Packard microwave test set in the reflection mode. This test set was also interfaced with a waveguide installed in a constant temperature box such that the temperature coefficient of frequency could be calculated from the change in resonant frequency as a function of temperature.

In addition to the processing time advantage illustrated by FIG. 2, there are other advantages for the process of this invention. For example, the impurity levels of mixed powders are expected to remain near those of the precursor $BaTiO_3$ and $TiO_2$ powders, primarily due to the decrease in the milling time. The increase in impurity levels of conventionally processed powders, most significantly in Zr content, usually arises because of the additional milling time following calcination. At microwave frequencies even small increases in impurity levels have a negative impact upon dielectric loss. For instance, Q values of HPB grade $BaTiO_3$ based ceramic are about 10% higher than those for the less pure 5016 grade $BaTiO_3$ equivalents (i.e. Q value of HPB grade $BaTiO_3$ based sample with −2 wt. percent $TiO_2$ compensation is =10,448 vs. 5016 grade based =9664).

Several advantages result from using a dispersant to improve mixing efficiency of the precursor powders. For example water content being used for ball milling with dispersant (e.g. 300 ml for 1 liter container and 1 kg batch size) is reduced by a factor of 6 relative to conventional processing without the dispersant (e.g. 1800 ml of water for a 4 l container and 1 kg batch size) thus facilitating drying. In addition, for a given container size, the dispersant also provides a loading factor advantage of at least 3 (e.g. for spray drying).

The tabulated Q values shown in Tables I and II are those measured at 4 GHz for annealed samples (annealing at 1150° C. for 6 hours, then cooling down at 100° C./hr). The data in FIG. 3 show that, generally, annealed HPB grade $BaTiO_3$ based ceramic samples have ≧10% higher Q's than unannealed samples.

The data presented in Table I illustrate the effects of sintering conditions and composition on the dielectric and physical properties of dispersed HPB ceramic and establish the parameters necessary to produce reactively sintered, high Q, crack-free material. Table I shows the effect of sintering conditions and composition on microcracking behavior after the samples have been boiled in water for 16 hours and tested for dye absorption. Consistently crack-free ceramic (indicated by an O in the Tables) are obtained when the $TiO_2$ compensation ranges between −1.75 and −2.75 wt. % (preferred compensation range) and heating rates are of less than 200° C./hr. The data also show that the cracking tendencies of ceramic within the preferred compensation range are insensitive to sintering temperature and soak time at temperature.

Table I also demonstrates the influence of composition and sintering parameters on the dielectric loss quality factor Q for annealed samples. It can be observed that within the preferred compensation range, Q for uncracked ceramic is primarily temperature dependent. It is shown that with an increase in temperature from 1350° C. to 1410° C. at a constant heating rate of 100° C. hr. and a soak time of 12 hrs., Q increases from less than 10,000 to well above 10,000. Q's in excess of 9000 can be obtained at sintering temperatures of 1350° C. which provides a measure of tolerance for obtaining ceramic with acceptable losses over a fairly broad sintering range. The data also show that a soak time of 1 hr. is sufficient to produce Q's of 10,000. The change in composition within the preferred compensation range does not appear to be a major factor. A great deal of scatter in Q values can also be observed in the measured values of those ceramic parts that are outside the preferred compensation range which is typically due to the effect of microcracking and absorbed moisture within the cracks.

With the exception of the rapidly heated samples (≧200° C./hr.), phase development with increasing Ba content generally parallel that observed for conventionally prepared ceramic series. Sintered samples with from 0.0 through −1.5 wt. % $TiO_2$ compensation typically exhibit decreasing $TiO_2$ second phase with a corresponding trend of less severe microcracking. Samples with −1.75 wt. % $TiO_2$ through −3.00 wt. % $TiO_2$ compensation exhibit increasing $BaTi_4O_9$ as a second phase and, with the exception of −3.00 wt. % $TiO_2$, structural stability. At 0.0 wt. % $TiO_2$ compensation much porosity is present due to inclusions of $TiO_2$. At −1.75 wt. % $TiO_2$ compensation $BaTi_4O_9$ occurs as increasingly larger patches with no obvious $TiO_2$. While these inhomogeneities may slightly affect the upper and lower boundaries of the preferred compensation range in terms of structural stability, the effect on Q appears to be minimal. The porosity decreases as the ceramic becomes Ba rich and then at −3.00 wt. % $TiO_2$ compensation, becomes quite porous. Microcracking of samples with −3.00 wt. % $TiO_2$ compensation in this case may be a function of the size of the $BaTi_4O_9$ patches rather than an intrinsic material property.

The effect of rapid heating rates (≧200° C./hr.) on structural stability, or rather instability, of sintered samples, may be explained with reference to a sample with a −2.0 wt. % $TiO_2$ compensation. Such a sample when heated at 400° C./hr. to 1410° C., then quenched, shall exhibit a Ba-rich, frozen liquid film present on top of a fine grained $Ba_2Ti_9O_{20}$ matrix and typically shall result in microcracking. Similarly, a sample that has also been rapidly heated, held at temperature for 4 hours and cooled at a rate of 100° C./hr., shall typically exhibit severe microcracking (with sufficient time at temperature and/or slow cooling, the low melting, Ba-rich liquid phase, shall consolidate producing macroscopic sized crystallites of $BaTi_4O_9$ through the structure which lead to the microcracking). In contrast, a surface of a sample heated to 1410° C. at the heating rate of 100° C./hr. and held (soaked) for a period of from 1 to 24 hours, would show a lack of macroscopic $BaTi_4O_9$ grains, a smaller average grain size distribution and possess a microstructure that will not develop microcracking. The formation of $Ba_2Ti_9O_{20}$ is a slow, time dependent process requiring an orderly transition through several lower melting, intermediate phases ($Ba_6Ti_{17}O_{40}$, $Ba_4Ti_{13}O_{20}$, etc.) When sufficient time is allowed for the transition to occur, a normal microstructure is produced. If sufficient time during heating is not allowed for the intermediate phases to form and disappear, $BaTi_4O_9$ grains will develop to a size that cannot be accommodated by the matrix phase. For these reasons, the heating rate for the samples in the preferred range of $TiO_2$ compensation, is limited to less than 200° C./hr.

Having established the sintering and composition parameters necessary to reactively sinter crack-free ceramic from dispersed HPB grade $BaTiO_3$ based powder mixtures, a group of dispersed 5016 grade $BaTiO_3$ and nondispersed HPB grade $BaTiO_3$ powder mixtures covering a narrower range of compositions (−1.50 to −2.00 wt. % $TiO_2$ compensation) than the preferred composition (−1.75 to −2.75 wt. % $TiO_2$) were prepared for comparison studies. The microcracking tendencies and Q values of these materials have been summarized and compared with equivalent dispersed HPB grade $BaTiO_3$ ceramic in Table II. Out of expediency, the value of −2.00 wt % $TiO_2$ compensation has been selected as a cut-off value for the comparison purposes on the basis of an expectation of similarity in the microcracking tendencies and Q values of mixtures with $TiO_2$ compensation above the −2.00 wt. % cut-off value.

Table II shows that the structural stability of 5016 grade $BaTiO_3$ based ceramic at −1.50 wt. % and −1.75 wt. % $TiO_2$ compensation is more sensitive to sintering temperature, heating rate and soak time than the dispersed HPB grade $BaTiO_3$ based ceramic with similar $TiO_2$ compensation. It is not until the 5016 grade $BaTiO_3$ composition is adjusted by −2.0 wt. % $TiO_2$ compensation that similar behavior is obtained between HPB and 5016 grade $BaTiO_3$ materials. The reason for this is that 5016 grade $BaTiO_3$ is supplied with a Ba:Ti ratio $<1$. HPB grade $BaTiO_3$ has a Ba:Ti ratio of $>1$. Thus a larger negative $TiO_2$ compensation is required for 5016 grade $BaTiO_3$ material to produce equivalent results.

The 5016 grade $BaTiO_3$ series with −1.5 wt. percent $TiO_2$ compensation exhibit microcracking due to the presence of $TiO_2$ in specimens as a second phase. However, in specimens with −2.00 wt. percent $TiO_2$ compensation, $TiO_2$ does not appear while $BaTi_4O_9$ occurs as small well dispersed crystallites permitting a structure free of microcracking at heating rates below 200° C./hr. Similarly, Q's of crack-free dispersed 5016 grade $BaTiO_3$ based ceramic are more affected by composition, sintering temperature and soak time than the dispersed HPB grade $BaTiO_3$ based equivalents. Q's in excess of 9000 are not consistently achieved for the dispersed 5016 grade $TiO_2$ with −2.0 wt. % $TiO_2$ compensation until a sintering temperature of 1410° C. at soak times $\geqq 1$ hour are employed.

The nondispersed HPB grade $BaTiO_3$ series (−1.50 wt. % $TiO_2$ −1.75 wt. % $TiO_2$ and −2.00 wt. % $TiO_2$ compensation) provided for comparison purposes exhibit microcracking and consistently lower Q values under all sintering conditions. It is only when these powders are subsequently calcined and ball milled (as in a conventional processing), thus improving the homogeneity of the powder, they yield crack-free ceramic. However, their Q values are also lower. For example, non-dispersed HPB grade $BaTiO_3$ samples when calcined and milled and then heated to 1410° C. at a rate of 100° C. and soaked for 12 hours, exhibited Q values of 6,798, 7,206 and 7,206 for $TiO_2$ compensations of −1.50, −1.75 and −2.00 wt. percent, respectively, which were low relative to the dispersed samples.

A comparison of the dispersed and nondispersed HPB grade $BaTiO_3$ data in Table II document the impact of the use of a dispersant. From the data it can be concluded that the reactive sintering process is not effective unless a dispersant is used to optimize mixing. Poor homogeneity, even after 16 hrs. of mixing of a nondispersed powder, cannot be overcome by solid state diffusion during the reactive sintering process.

Results from sintered specimens of the spray dried powders using HPB grade $BaTiO_3$ with −1.75 wt. % $TiO_2$ compensation and 5016 grade $BaTiO_3$ with −2.00 wt. % $TiO_2$ compensation demonstrated that the process outlined in FIG. 2 was a viable fabrication method. Average Q's of 25 samples of each were 10,817 and 9,721, respectively, with a standard deviation of less than 1 percent. These ceramics also produce a dense microstructure with little or no porosity and easily survive the most rigorous hot water treatment and dye testing for microcracking. The microstructures of both were also similar in appearance, including well-dispersed, small crystallites of $BaTiO_4O_9$ in the $Ba_2Ti_9O_{20}$ matrix.

Figure 5:
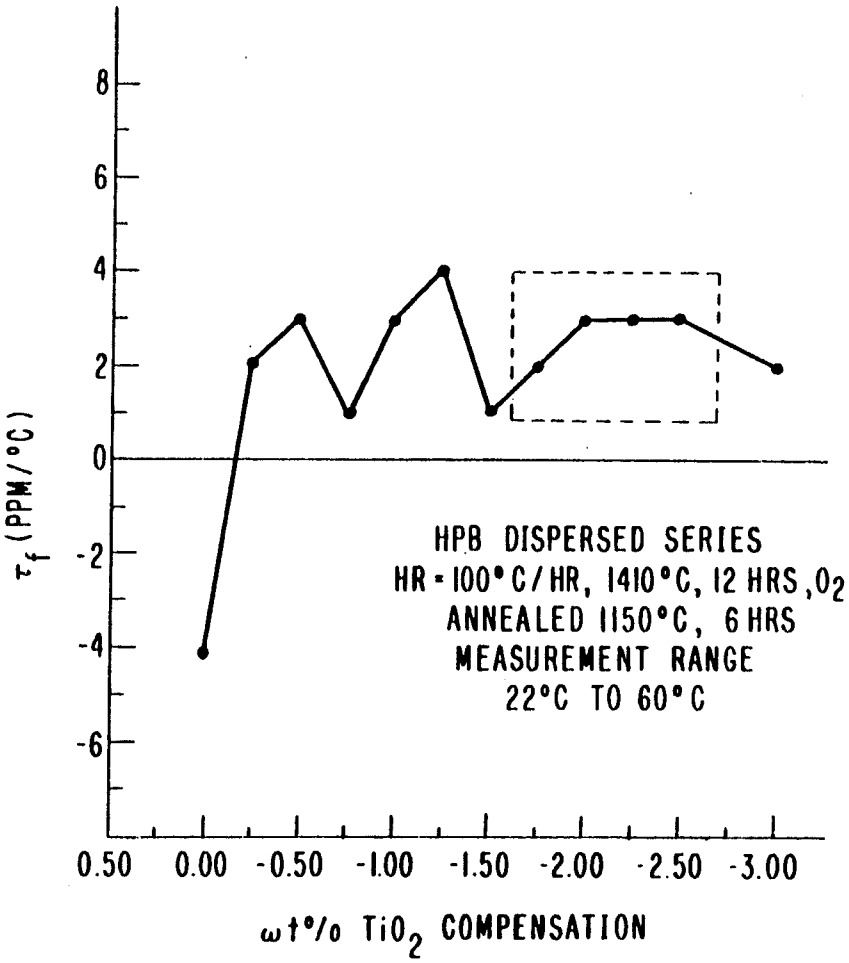
Figure 4:
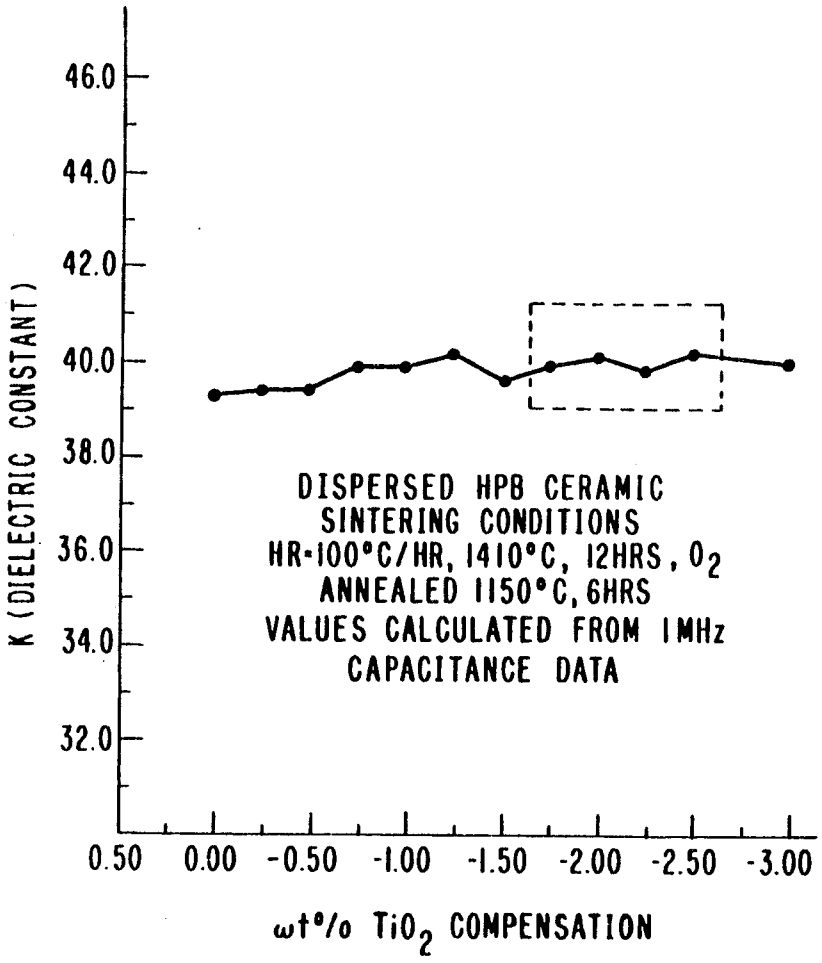

Dielectric constants (K) and temperature coefficients of frequency ($T_f$) data have been summarized and presented in FIGS. 4 and 5 as functions of composition for the dispersed HPB grade $BaTiO_3$ ceramic. K appears to be little affected by composition across the entire range. A value near 40 has been calculated for all of the compositions which is also characteristic of the conventionally processed ceramic (39.6). With the exception of specimens with 0.0 wt. % $TiO_2$ compensation, which has a significant amount of $TiO_2$ as second phase and a $T_f$ of −4 ppm/°C., $T_f$ is within a range of 2±2 ppm/°C. for these other ceramics. This value is in good agreement with the conventionally processed $Ba_2Ti_9O_{20}$ of 2±1 ppm °C.

Figure 7:
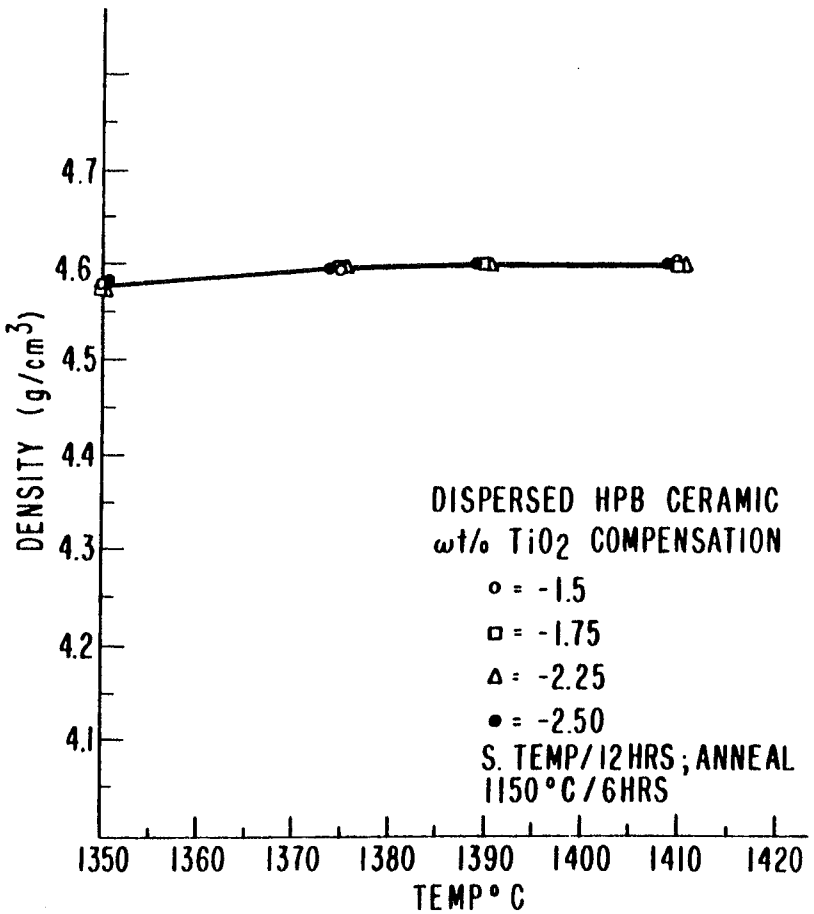
Figure 6:
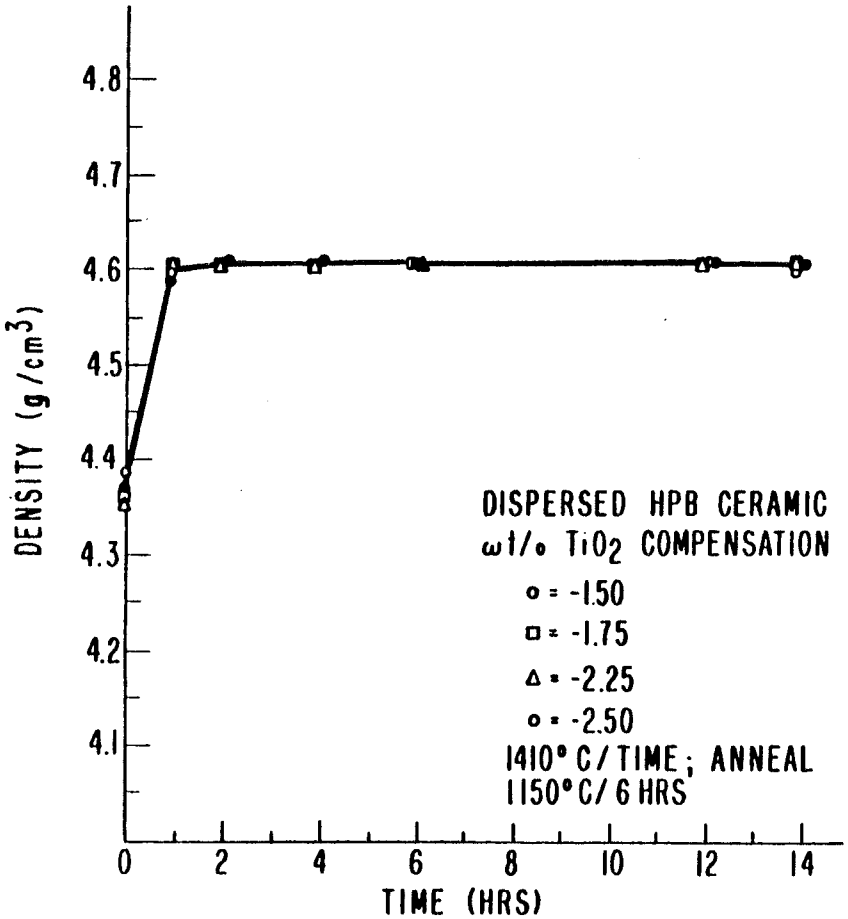

Density data have been obtained from representative dispersed, HPB grade $BaTiO_3$ material and are presented in FIGS. 6 and 7. It is shown that for compositions near and within the preferred compensation range densities are $\geqq 99\%$ of the theoretical values of 4.600 g/cm$^3$. Below a sintering temperature of 1350° C. density decreases rapidly (not shown) while at higher temperatures only slight improvement could be obtained when soak times were extended beyond one hour.

The above data and information shows that reactive sintering combined with the processing steps described hereinabove, is a viable fabrication method for producing high Q, dense and crack-free ceramic suitable for microwave devices. HPB grade $BaTiO_3$ and the anatase form of $TiO_2$ are the preferred precursor powders for producing $Ba_2Ti_9O_{20}$ ceramic. Formulation should provide a slight excess of Ba (e.g. from −1.75 to −2.75 wt. percent $TiO_2$ compensation). A dispersant, to optimize mixing of the ingredients is essential to the successful implemenation of the process and heating rates during sintering must be less than 200° C./hr. to minimize liquid Ba-rich phase formation during the initial phase of reactive sintering. This processing then provides at least the following advantages over conventional ceramic processing: processing time can be reduced by two-thirds, purity levels are maintained near precursor levels, powder volume can be increased without additional equipment, liquid volume (e.g. water) for mixing purposes is minimized thus facilitating drying of the mixed slurries, and Q's of annealed HPB grade $BaTiO_3$ based specimen in excess of 10,000 are rountinely obtained at higher sintering temperatures (≦1400° C.). Q's in excess of 9,000 can also be achieved at temperatures as low as 1350° C. The use of a dilute acid to flocculate the dispersed powders (to neutralize the deflocculating effects of the dispersant) after mixing enables production of homogeneous, binderless powders for subsequent processing; the precursor should be insoluble in the "flocculant".

Other ceramic materials useable in microwave devices, such as $BaTi_4O_9$, $ZrTiO_4$, and $ZrTiO_4$ (Sn), may be produced utilizing the above teachings. One of average skill in the art shall have no difficulty in devising suitable modifications and changes which will embody the principles of the invention and fall within the spirit and scope thereof.

TABLE I

Q Values (Measured at 4 GHz) and Microcracking Behavior of Dispersed HPB Based Ceramics

| BaTiO3 | HPB | | HPB | | HPB | | HPB | | HPB | | HPB | | HPB | | HPB | |
|---|---|---|---|---|---|---|---|---|---|---|---|---|---|---|---|---|
| Dispersant | YES | | YES | | YES | | YES | | YES | | YES | | YES | | YES | |
| wt. % $TiO_2$ Compensation | −1.25 | | −1.50 | | −1.75 | | −2.00 | | −2.25 | | 2.50 | | −2.75 | | −3.00 | |
| Mole % $TiO_2$ | 81.672 | | 81.643 | | 81.613 | | 81.584 | | 81.554 | | 81.524 | | 81.494 | | 81.464 | |
| Sintering Temp (°C.)* | | | | | | | | | | | | | | | | |
| 1350 | 9367 | / | 9707 | 0 | 9484 | 0 | 9857 | 0 | 10133 | 0 | 9485 | 0 | 9470 | 0 | 9460 | x |
| 1375 | 9994 | / | 9833 | 0 | 9961 | 0 | 9672 | 0 | 10329 | 0 | 9796 | 0 | 9710 | 0 | 9347 | x |
| 1390 | 9911 | / | 10394 | / | 10281 | 0 | 10387 | 0 | 10383 | 0 | 10269 | 0 | 10291 | 0 | 9189 | x |
| 1410 | 10074 | x | 10324 | / | 11111 | 0 | 10448 | 0 | 11099 | 0 | 10775 | 0 | 10836 | 0 | 7795 | x |
| Heating Rate (°C./Hr)** | | | | | | | | | | | | | | | | |
| 50 | 9864 | 0 | 9668 | 0 | 10468 | 0 | 10371 | 0 | 10393 | 0 | 10425 | 0 | 10405 | 0 | 9261 | x |
| 100 | 10074 | x | 10324 | / | 11111 | 0 | 10448 | 0 | 11099 | 0 | 10775 | 0 | 10836 | 0 | 7795 | x |
| 200 | 7304 | x | 7840 | x | 8512 | x | 8212 | x | 8316 | x | 8199 | x | 7977 | x | 7641 | x |
| 300 | 5721 | x | 5949 | x | 6286 | x | 5639 | x | 6075 | x | 6400 | x | 6906 | x | 5706 | x |
| 400 | 6336 | x | 6854 | x | 7248 | x | 6742 | x | 4759 | x | 7387 | x | 6835 | x | 4468 | x |
| Soak Time (Hr)*** | | | | | | | | | | | | | | | | |
| 1 | 9561 | x | 9192 | / | 10298 | 0 | 10585 | 0 | 10565 | 0 | 10555 | 0 | 10596 | 0 | 9468 | x |
| 2 | 9610 | x | 10018 | 0 | 10781 | 0 | 10278 | 0 | 10334 | 0 | 10244 | 0 | 10275 | 0 | 9537 | x |
| 4 | 9300 | x | 9860 | / | 10951 | / | 10367 | 0 | 10680 | 0 | 10465 | 0 | 10397 | 0 | 8710 | x |
| 6 | 9791 | x | 10214 | 0 | 10566 | 0 | 10646 | 0 | 10441 | 0 | 10648 | 0 | 10397 | 0 | 9403 | x |
| 12 | 10074 | x | 10324 | / | 11111 | 0 | 10448 | 0 | 11099 | 0 | 10775 | 0 | 10622 | 0 | 7795 | x |
| 24 | 10123 | x | 10051 | / | 10863 | 0 | 10510 | 0 | 10667 | 0 | 10586 | 0 | 10836 | 0 | 9215 | x |

*Heating Rate = 100° C./Hr., Soak = 12 Hr.
**Sinter 1410° C., Soak = 12 Hr.
***Sinter 1410° C., Heating Rage = 100° C./Hr.
x = Absorption of Dye Indicating Severe Microcracking
/ = Slight Absorption
0 = No Absorption

TABLE II

Q Values (Measured at 4 GHz) and Microcracking Behavior for HPB and 5016 Dispersed and HPB Non-Dispersed RS Ceramics

| BaTiO3 | HPB | | 5016 | | HPB | | HPB | | 5016 | | HPB | | HPB | | 5016 | | HPB | |
|---|---|---|---|---|---|---|---|---|---|---|---|---|---|---|---|---|---|---|
| Dispersant | YES | | YES | | No | | YES | | YES | | No | | YES | | YES | | No | |
| wt. % $TiO_2$ Compensation | −1.50 | | −1.50 | | −1.50 | | −1.75 | | −1.75 | | 1.75 | | −2.00 | | −2.00 | | −2.00 | |
| Mole % $TiO_2$ | 81.643 | | 81.643 | | 81.643 | | 81.613 | | 81.613 | | 81.613 | | 81.584 | | 81.584 | | 81.584 | |
| Sintering Temp (°C.)* | | | | | | | | | | | | | | | | | | |
| 1350 | 9707 | 0 | 8449 | 0 | 7966 | x | 9484 | 0 | 6484 | 0 | 6243 | x | 9857 | 0 | 6707 | 0 | 484[illegible] | x |
| 1375 | 9833 | 0 | 7849 | 0 | 8681 | 0 | 9961 | 0 | 6957 | 0 | 7080 | x | 9672 | 0 | 6606 | 0 | 6586 | x |
| 1390 | 10394 | / | 7867 | x | 5905 | x | 10281 | 0 | 7132 | 0 | 5374 | x | 10387 | 0 | 7373 | 0 | 5588 | x |
| 1410 | 10324 | / | 8560 | x | 5592 | x | 11111 | 0 | 9572 | 0 | 7206 | 0 | 10448 | 0 | 9664 | 0 | 5623 | x |
| Heating Rate (°C./Hr)** | | | | | | | | | | | | | | | | | | |
| 50 | 9192 | 0 | 7341 | x | 7426 | x | 10468 | 0 | 7791 | x | 4897 | x | 10371 | 0 | 8904 | 0 | 6394 | x |
| 100 | 1032 | / | 8560 | x | 5592 | x | 11100 | 0 | 9572 | x | 5907 | x | 10448 | 0 | 9664 | 0 | 5623 | x |
| 200 | 7840 | x | 7101 | x | 6310 | x | 8512 | x | 7925 | x | 5923 | x | 8212 | x | 7918 | x | 5720 | x |
| 300 | 5949 | x | 6215 | x | 6002 | x | 6286 | x | 7778 | x | 5905 | x | 5639 | x | 7377 | x | 6250 | x |
| 400 | 6854 | x | 8094 | x | 5677 | x | 7248 | x | 7515 | x | 6195 | x | 6742 | x | 6974 | x | 6249 | x |
| Soak Time (Hr)*** | | | | | | | | | | | | | | | | | | |
| 1 | 9192 | / | 8685 | x | 5467 | x | 10298 | 0 | 8784 | 0 | 5664 | / | 10585 | 0 | 9245 | 0 | 5303 | x |
| 2 | 10018 | 0 | 8402 | x | 5708 | x | 10781 | 0 | 8678 | 0 | 6352 | / | 10278 | 0 | 9406 | 0 | 5523 | x |
| 4 | 9860 | / | 7690 | x | 8427 | x | 10951 | 0 | 7271 | 0 | 6042 | 0 | 10367 | 0 | 9265 | 0 | 7476 | x |
| 6 | 10214 | 0 | 9031 | x | 8565 | x | 10566 | 0 | 9105 | 0 | 6418 | / | 10646 | 0 | 9892 | 0 | 8039 | x |
| 12 | 10324 | / | 8560 | x | 5592 | x | 11111 | 0 | 9572 | x | 5907 | / | 10448 | 0 | 9664 | 0 | 5623 | x |
| 24 | 10051 | / | 8837 | x | 8596 | x | 10863 | 0 | 8978 | x | 6053 | / | 10510 | 0 | 9742 | 0 | 6180 | x |

*Heating Rate = 100° C./Hr., Soak = 12 Hr.
**Sinter 1410° C., Soak = 12 Hr.
***Sinter 1410° C., Heating Rate = 100° C./Hr.
x = Absorption of Dye Indicating Severe Microcracking
/ = Slight Absorption
0 = No Absorption

I claim:

1. A method of fabricating a microwave device, comprising the steps of preparing a body of dielectric material selected from the group consisting of dielectric materials having the nominal formula $Ba_2Ti_9O_{20}$, $BaTi_4O_9$, and $ZrTiO_4$, and assembling said microwave device which comprises body of dielectric material, a means for introducing microwave electrical energy to the dielectric material, and a conducting member to contain the microwave electrical energy in the device, in which said body of dielectric material is prepared by the steps consisting essentially of mixing a slurry comprising oxidic precursor powders of said dielectric material, water and a dispersant, the amount of such precursor powders being sufficient to result upon sintering in a material with said nominal formula, said dispersant resulting in the reduction of the volume of water being used in the slurry and in improving the blending of the powers, said mixing being conducted for a period sufficient to result in blending of precursor powders, drying the mixture, said drying being selected from a) spray-drying the mixed slurry preceded by an inclusion into the slurry of organic materials including binders, plasticizers, lubricants and anti-foaming agents; and b) adding to the mixed slurry a dilute acid as a flocculating agent in an amount sufficient to neutralize effects of the dispersant, oven drying the flocculated slurry and screening the dried mixture, forming the dried mixture into a green form body, and sintering the formed body in an oxygen atmosphere, said sintering including heating the formed body at a rate of less than 200° C. per hour to a temperature sufficient to simultaneously react and sinter the precursor powders into said dielectric material body, soaking the body at said temperature for a period of up to 24 hours, and, optionally annealing the sintered body in an oxygen atmosphere for a period of up to 100 hours, the so-processed body having Q values (low microwave losses) in excess of 9000.

2. The method of claim 1 in which said dispersant is selected from the group consisting of complex glassy phosphates, condensed arylsulfonic acids and ammoniated polyacrylates.

3. The method of claim 2 in which said dispersant is an ammoniated polyacrylate added in an amount of from 0.7 to 1.2 wt. percent based on the weight of dry precursor powders.

4. The method of claim 3 in which said dispersant is added in an amount of about 0.9 wt. percent based on the weight of dry precursor powders.

5. The method of claim 1 in which the said flocculating agent is acetic acid added as a 25–75 volume percent solution.

6. The method of claim 5 in which said acetic acid is added in an amount of about 10–20 ml. of a 50 volume percent solution per 1 kg of dry precursor powders.

7. The method of claim 1 in which said mixing is conducted for about 6 hours.

8. The method of claim 1 in which said mixing prior to the spray-drying step is conducted for a period of up to 6 hours.

9. The method of claim 1 in which one of said precursor powders is $TiO_2$, and the amount of $TiO_2$ being added is reduced relatively to a required stoichiometric amount by an amount sufficient to avoid microcracking of the sintered body.

10. The method of claim 9 wherein the amount of $TiO_2$ powder is reduced by from 1.5 to 3 wt. percent.

11. The method of claim 10 in which the said reduction preferably ranges from 1.75 to 2.75 wt. percent.

12. The method of claim 1 in which said sintering temperature ranges from 1350° C. to 1420° C.

13. The method of claim 1 in which the sintered body is optionally annealed in an oxygen atmosphere at a temperature ranging from 900° C. to 1400° C. for a period of up to 100 hours.

14. A method of fabricating a microwave device, comprising the steps of preparing a body of dielectric material selected from the group consisting of dielectric materials having the nominal formula $Ba_2Ti_9O_{20}$, $BaTi_4O_9$, and $ZrTiO_4$ and assembling said microwave device which comprises a body of dielectric material, a means for introducing microwave electrical energy to the dielectric material, and a conducting member to contain the microwave electrical energy in the device, in which said body of dielectric material is prepared by the steps consisting essentially of, preparing a slurry comprising precursor powders of said dielectric material, water, dispersant, and organic ingredients including binders, plasticizers, lubricants and anti-foaming agents, the amount of such precursor powders being sufficient to result upon sintering in a material with said nominal formula, said dispersant resulting in the reduction of the volume of water being used in the slurry and in improving the blending of the powders, mixing said slurry for a period sufficient to result in blending of the precursor powders, spray-drying the mixture, forming the dried mixture into a desired green form body, and sintering the green form body in an oxygen atmosphere, said sintering including heating the formed body at a rate of less than 200 degree C. per hour to am temperature sufficient to react and sinter the precursor powders into said dielectric material body, and soaking the body at said temperature for a period of up to 24 hours, and optionally, annealing the sintered body in an oxygen atmosphere for a period of up to 100 hours, the so-processed body having Q values (low microwave losses) in excess of 9000.

15. The method of claim 14 in which the oxidic ingredients comprise $BaTiO_3$ and an anatase form of $TiO_2$.

16. The method of claim 14 wherein an excess of Ba is provided by reducing from 1.5 to 3 wt. percent the amount of $TiO_2$ powder needed to produce a desired weight of stoichiometric $Ba_2Ti_9O_{20}$.

17. The method of claim 16 in which the said reduction preferably ranges from 1.75 to 2.75 wt. percent.

18. The method of claim 14 in which said dispersant is selected from the group consisting of complex glassy phosphates, condensed arylsulfonic acids and ammoniated polyacrylates.

19. The method of claim 18 in which said dispersant is an ammoniated polyacrylate added in an amount of from 0.7 to 1.2 wt. percent based on dry precursor powders.

20. The method of claim 19 in which said dispersant is added in an amount of about 0.9 wt. percent based on dry precursor powders.

21. The method of claim 14 in which said sintering temperature ranges from 1350° C. to 1420° C.

22. The method of claim 16 in which said mixing prior to the spray drying is conducted for up to 6 hours.

23. The method of claim 14 in which the green formed body is heated at a rate of up to 100° C./hr.

24. The method of claim 23 in which said body is heated to a temperature of about 1410° C. and soaked at said temperature for a period of about 12 hours.

25. The method of claim 14 in which the said annealing is conducted at a temperature ranging from 900° C. to 1400° C.

26. A method of fabricating a microwave device, comprising the steps of preparing a body of dielectric material selected from the group consisting of dielectric materials having the nominal formula $Ba_2Ti_9O_{20}$, $BaTi_4O_9$, and $ZrTiO_4$, and assembling said microwave device which comprises a body of dielectric material, a means for introducing microwave electrical energy to the dielectric material and a conducting member to contain the microwave electrical energy in the device, in which said body of dielectric material is prepared by the steps consisting essentially of preparing a slurry comprising oxidic precursor powders of dielectric material, water and a dispersant, the amount of such precursor powders being sufficient to result upon sintering in a material with said nominal formula, said dispersant resulting in the reduction of the volume of water being used in the slurry and in improving the blending of the powders, mixing said slurry for a period sufficient to result in blending of the precursor powders, adding to said mixture a dilute acid as a flocculating agent in an amount sufficient to neutralize effects of the dispersant, drying the mixture followed by screening of the dried material, forming the screened dried mixture into a green form body, and sintering the formed body in an oxygen atmosphere, said sintering including heating the formed body at a rate of less than 200° C. per hour to a temperature sufficient to simultaneously react and sinter the precursor powders into said dielectric material body, soaking the body at said temperature for a period of up to 24 hours, and, optionally annealing the sintered body in an oxygen atmosphere for a period of up to 100 hours, the so-processed body having Q values (low microwave losses) in excess of 9000.

27. The method of claim 26 in which said dispersant is selected from the group consisting of complex glassy phosphates, condensed arylsulfonic acids and ammoniated polyacrylates.

28. The method of claim 3 in which said dispersant is an ammoniated polyacrylate added in an amount of from 0.7 to 1.2 wt. percent based on the weight of dry precursor powders.

29. The method of claim 28 in which said dispersant is added in an amount of about 0.9 wt. percent based on the weight of dry precursor powders.

30. The method of claim 26 in which the said flocculating agent is acetic acid added as a 25–75 volume percent solution.

31. The method of claim 30 in which said acetic acid is added in an amount of about 10–20 ml. of a 50 volume percent solution per 1 kg of dry precursor powders.

32. The method of claim 26 in which said mixing is conducted for about 6 hours.

33. The method of claim 26 in which one of said precursor powders is $TiO_2$, and the amount of $TiO_2$ being added is reduced relatively to a required stoichiometric amount by an amount sufficient to avoid microcracking of the sintered body.

34. The method of claim 33 in which the amount of $TiO_2$ powder is reduced by from 1.5 to 3 wt. percent.

35. The method of claim 34 in which the said reduction preferably ranges from 1.75 to 2.75 wt. percent.

36. The method of claim 26 in which said sintering temperature ranges from 1350° C. to 1420° C.

37. The method of claim 26 in which the sintered body is optionally annealed in an oxygen atmosphere at a temperature ranging from 900° C. to 1400° C. for a period of up to 100 hours.

38. A method of fabricating a body of dielectric material by the steps consisting essentially of preparing a slurry comprising precursor powders including oxidic ingredients of Ba and Ti, water and a dispersant, the amount of such ingredients being sufficient to result in a material with a nominal formula $Ba_2Ti_9O_{20}$, said dispersant resulting in the reduction of the volume of water being used in the slurry and in improving the blending of the powders, mixing said slurry for a period sufficient to result in blending of the precursor powders, drying the mixture, said drying being selected from a) spray-drying the mixed slurry preceded by an inclusion into the slurry of organic materials including binders, plasticizers, lubricants and anti-foaming agents; and b) adding to the mixed slurry a dilute acid as a flocculating agent in an amount sufficient to neutralize effects of the dispersant, oven drying the flocculated slurry and screening the dried mixture, forming the dried mixture into a green form body, and sintering the formed body in an oxygen atmosphere, said sintering including heating the formed body at a rate of less than 200° C. per hour to a temperature sufficient to simultaneously react and sinter the precursor powders into said dielectric material body, soaking the body at said temperature for a period of up to 24 hours, and, optionally annealing the sintered body in an oxygen atmosphere for a period of up to 100 hours, the so-processed body having Q values (low microwave losses) in excess of 9000.

39. The method of claim 38 in which the oxidic ingredients comprise $BaTiO_3$ and an anatase form of $TiO_2$.

40. The method of claim 38 wherein an excess of Ba is provided by reducing from 1.5 to 3 wt. percent the amount of $TiO_2$ powder needed to produce a desired weight of stoichiometric $Ba_2Ti_9O_{20}$.

41. The method of claim 40 in which the said reduction preferably ranges from 1.75 to 2.75 wt. percent.

42. The method of claim 38 in which said dispersant is selected from the group consisting of complex glassy phosphates, condensed arylsulfonic acids and ammoniated polyacrylates.

43. The method of claim 42 in which said dispersant is an ammoniated polyacrylate added in an amount of from 0.7 to 1.2 wt. percent based on dry precursor powders.

44. The method of claim 43 in which said dispersant is added in an amount of about 0.9 wt. percent based on dry precursor powders.

45. The method of claim 38 in which said flocculating agent is acetic acid added as a 25–75 volume percent aqueous solution.

46. The method of claim 45 in which said acetic acid is added in an amount of about 10–20 ml. of a 50 volume percent aqueous solution per 1 kg. of dry precursor powders.

47. The method of claim 38, in which said mixing is conducted for 6 hours.

48. The method of claim 38 in which said mixing prior to the spray drying is conducted for up to 6 hours.

49. The method of claim 38 in which the green formed body is heated at a rate of up to 100° C./hr.

50. The method of claim 49 in which said body is heated to a temperature of about 1410° C. and soaked at said temperature for a period of about 12 hours.

51. The method of claim 38 in which the said annealing is conducted at a temperature ranging from 900° C. to 1400° C.

52. The method of claim 1, in which said dielectric material has nominal formula $Ba_2Ti_9O_{20}$.

53. The method of claim 14, in which said dielectric material has nominal formula $Ba_2Ti_9O_{20}$.

54. The method of claim 26, in which said dielectric material has nominal formula $Ba_2Ti_9O_{20}$.

* * * * *